US005584738A

United States Patent [19]

Nishimura et al.

[11] Patent Number: 5,584,738

[45] Date of Patent: Dec. 17, 1996

[54] CATHODE RAY TUBE APPARATUS AND METHOD OF MANUFACTURING THE SAME

[75] Inventors: Takashi Nishimura; Kazuyuki Seino; Yuuji Haraguchi; Eiji Kamohara, all of Fukaya, Japan

[73] Assignee: Kabushiki Kaisha Toshiba, Kawasaki, Japan

[21] Appl. No.: 547,550

[22] Filed: Oct. 24, 1995

Related U.S. Application Data

[62] Division of Ser. No. 421,282, Apr. 13, 1995, Pat. No. 5,498,921, which is a continuation of Ser. No. 49,316, Apr. 21, 1993, abandoned.

[30] Foreign Application Priority Data

Apr. 21, 1992 [JP] Japan ..... 4-100023
Mar. 16, 1993 [JP] Japan ..... 5-56182

[51] Int. Cl.[6] ..... H01J 9/24; H01J 9/42

[52] U.S. Cl. ..... 445/3; 445/24

[58] Field of Search ..... 445/24, 34, 3

[56] References Cited

U.S. PATENT DOCUMENTS 4,117,379 9/1978 Bijma .
4,130,836 12/1978 Kornaker .
4,186,414 1/1980 Barinek .
4,285,013 8/1981 Brunn et al. .
4,360,839 11/1982 Ragland, Jr. et al. .
4,449,951 5/1984 Nill ..... 445/3
4,606,729 8/1986 Kuiper ..... 445/3
4,638,219 1/1987 Pons .
4,668,893 5/1987 Ambosy .
4,712,038 12/1987 Takenaka et al. .
4,714,856 12/1987 Takenaka et al. .
4,777,407 10/1988 Takenaka et al. .
4,792,720 12/1988 Takenaka et al. .
4,803,559 2/1989 Soemers ..... 445/3
4,994,704 2/1991 Takenaka et al. .
5,032,756 7/1991 Takenaka et al. .
5,111,103 5/1992 Dubrucq .
5,176,556 1/1993 Morohashi ..... 445/3
5,227,692 7/1993 Lee .
5,287,034 2/1994 Kamohara et al. .
5,365,142 11/1994 Nishimura et al. .

*Primary Examiner*—P. Austin Bradley
*Assistant Examiner*—Jeffrey T. Knapp
*Attorney, Agent, or Firm*—Cushman Darby & Cushman IP Group of Pillsbury Madison & Sutro LLP

[57] ABSTRACT

A picture apparatus includes a vacuum envelope which has a phosphor screen and a plurality of electron gun assemblies for emitting electron beams to the phosphor screen, and a deflection device for deflecting the electron beams emitted from the electron gun assemblies. The deflection device has a plate-like coupling member arranged to face the vacuum envelope, and a plurality of elemental deflection units for deflecting the electron beams to scan the phosphor screen dividedly. The deflection units are fixed to the coupling member and located at predetermined positions, respectively.

5 Claims, 10 Drawing Sheets

CATHODE RAY TUBE APPARATUS AND METHOD OF MANUFACTURING THE SAME

This is a division of application No. 08/421,282, filed Apr. 13, 1985, now U.S. Pat. No. 5,498,921, which was a continuation of application No. 08/049,316, filed Apr. 21, 1993, now abandoned.

BACKGROUND OF THE INVENTION

1. Field of the Invention

This invention relates to a cathode ray tube apparatus wherein a phosphor screen is dividedly scanned by a plurality of electron beams, and a method of manufacturing the cathode ray tube apparatus.

2. Description of the Related Art

In recent years, considerable research has been conducted regarding the development of a standard-format or a wide-screen type high-resolution cathode ray tube suitable for high-quality broadcasting. In general, in order to achieve a cathode ray tube of high resolution, the spot diameter of an electron beam on a phosphor screen must be reduced. To this end, in the prior art, the structure of an electrode of an electron gun assembly was improved, or the caliber and/or length of the electron gun assembly was increased. However, the results obtained so far have not been fully satisfactory, the main reason for this being that the distance between the electron gun assembly and the phosphor screen increases in accordance with an increase in the size of the cathode ray tube, with the result that the magnification of the electron lens increases excessively. Accordingly, in order to achieve high resolution, it is most important that the distance (depth) between the electron gun assembly and the phosphor screen be reduced. In addition, if the deflection angle of an electron beam is increased, the difference in magnification between the center area and peripheral area of the phosphor screen increases. Thus, wide-angle deflection is not advantageous for achieving high resolution.

To overcome the above-described disadvantage, EP 0 471 359 A3 discloses a cathode-ray tube in which a flat face plate is employed and a phosphor screen is continuously formed on the inner surface of the face plate and comprises a plurality of regions which are simultaneously and independently scanned by electron beams emitted from a plurality of electron gun assembles. It is necessary to provided support means in the cathode-ray tube for supporting the face plate against the atmospheric pressure applied thereto.

However, even if the screen is formed integrally and the support means is provided in the cathode-ray tube, a practical problem still remains. Specifically, where scanning is performed simultaneously in plural regions of the screen, it is necessary to employ a simple structure and/or method so as to make connecting portions between adjacent pictures reproduced on the screen invisible.

The above-described cathode ray tube has a plurality of independent electron gun assemblies, and a plurality of deflection units (elemental deflection units, for deflecting plural electron beams emitted from the electron gun assemblies to scan a predetermined number of regions of the phosphor screen dividedly. The number of the deflection units is equal to that of the electron gun assemblies. To hide the connecting portions of adjacent regions scanned independent of one another, it is necessary to adjust the deflection units individually. This can be performed in the case where a small number of deflection units are employed, or where a monochrome image cathode ray tube which can be adjusted in a comparatively simple manner is used. However, an increase in the number of the deflection units will make it difficult to perform such adjustment. Further, in the case of a color image cathode ray tube, it is necessary to perform adjustment for color purity or beam-converging, in addition to such adjustment as moving a reproduced image in the vertical direction and horizontal direction, and/or rotating the same. Thus, it is extremely difficult to adjust all the deflection units appropriately.

SUMMARY OF THE INVENTION

The present invention is contrived in consideration of the above circumstances and its object is to provide a cathode ray tube apparatus of a type wherein a phosphor screen is dividedly scanned in a plurality of regions by a plurality of electron beams, and wherein a deflection device for respectively deflecting the electron beams to the predetermined regions can easily be adjusted in position relative to the cathode ray tube, and also to provide a method of manufacturing the apparatus.

To attain the above object, the cathode ray tube apparatus according to the invention comprises: a phosphor screen; a plurality of electron gun assemblies, each for emitting at least one electron beam to the phosphor screen; and deflection means for deflecting the electron beams emitted from the electron gun assemblies, the deflection means having a plurality of elemental deflection units corresponding to the respective electron gun assemblies, for deflecting the electron beams to scan the phosphor screen dividedly, and coupling means for coupling at least two of the elemental deflection units to one another.

Preferably, the deflection means has a plurality of adjusting means for adjusting the positions of the elemental deflection units in relation to the coupling means.

According to another aspect of the invention, the cathode ray tube apparatus has a vacuum envelope having the phosphor screen and electron gun assemblies, and adjusting means for adjusting the position of the coupling means in relation to the vacuum envelope.

With the cathode ray tube apparatus, a plurality of elemental deflection units are coupled with one another into one body by means of the coupling means, so that they can simultaneously be arranged in predetermined positions. When it is necessary to adjust the position of each elemental deflection unit to align a corresponding electron gun assembly, this adjustment can be performed by an adjusting means.

Further, since a plurality of elemental deflection units are arranged in predetermined positions by means of coupling means before attaching them to the cathode ray tube, it is not necessary to individually adjust the positions of the elemental deflection units relative to the electron gun assemblies. However, if adjustment of each deflection unit is necessary, the positions of the deflection units can simultaneously be adjusted by adjusting the position of the coupling means relative to the cathode ray tube by use of the adjusting means. Thus, adjustment of the deflection means to the cathode ray tube is significantly simplified.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the invention, and together with the general description given above and the detailed description of the preferred embodiments given below, serve to explain the principles of the invention.

FIGS. 1 to 3 show a cathode ray tube apparatus according to an embodiment of the invention, in which:

FIG. 1 is a perspective view showing the appearance of the apparatus,

FIG. 2 is a cross sectional view taken along line II—II of FIG. 1, and

FIG. 3 is a perspective view showing a deflection device of the apparatus;

FIGS. 4 to 7 show a cathode ray tube apparatus according to another embodiment of the invention, in which:

FIG. 4 is a cross sectional view of the apparatus,

FIG. 5 is a perspective view showing a deflection device of the apparatus,

FIG. 6 is a perspective view showing an adjusting/fixing mechanism, and

FIG. 7 is an exploded perspective view showing the adjusting/fixing mechanism;

FIGS. 8 and 9 show a cathode ray tube apparatus according to a further embodiment of the invention, in which:

FIG. 8 is a cross sectional view of the apparatus, and

FIG. 9 is a perspective view showing an adjusting fixing mechanism of the apparatus;

DETAILED DESCRIPTION OF THE PREFERRED EMBODIMENTS

The embodiments of the invention will be explained in detail with reference to the accompanying drawings.

Figure 1:
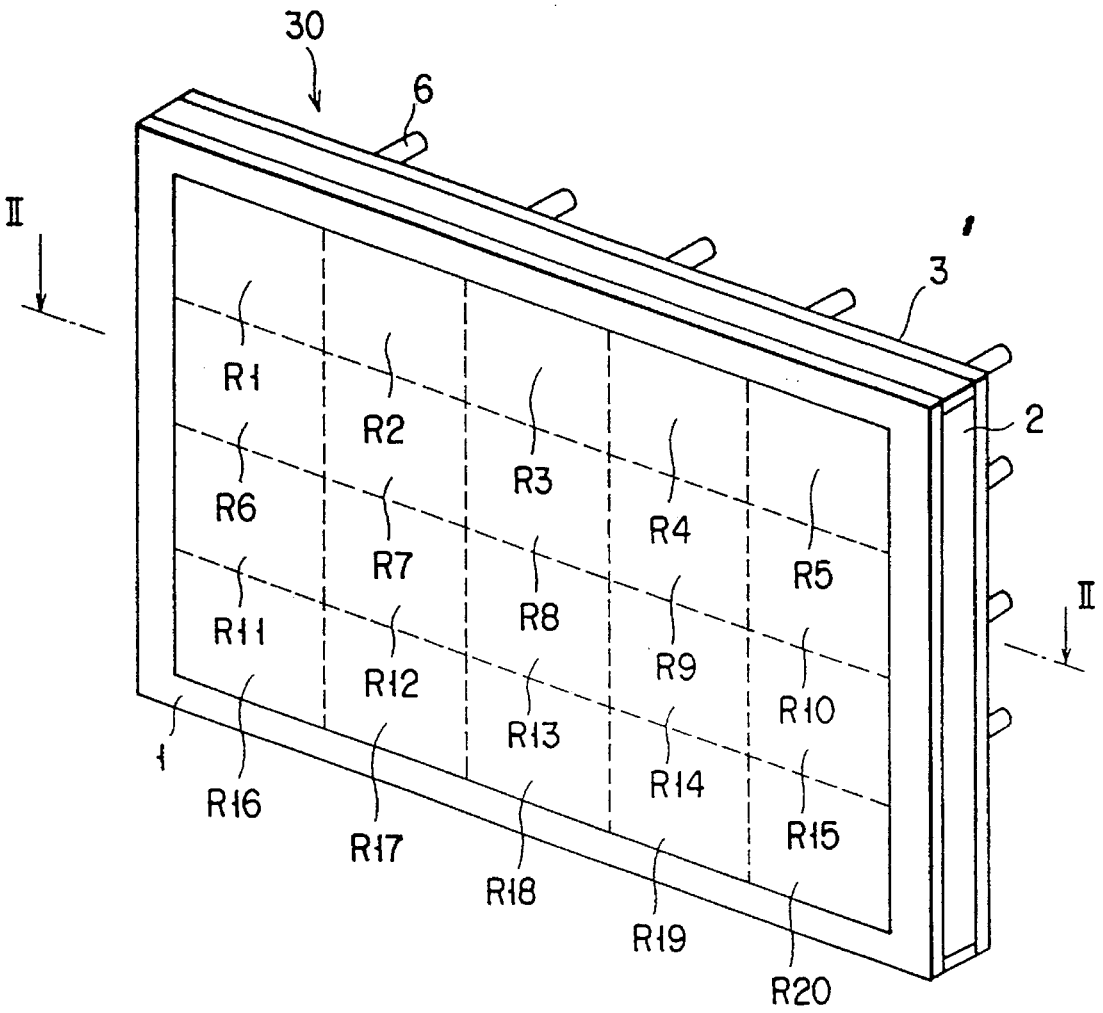
Figure 2:
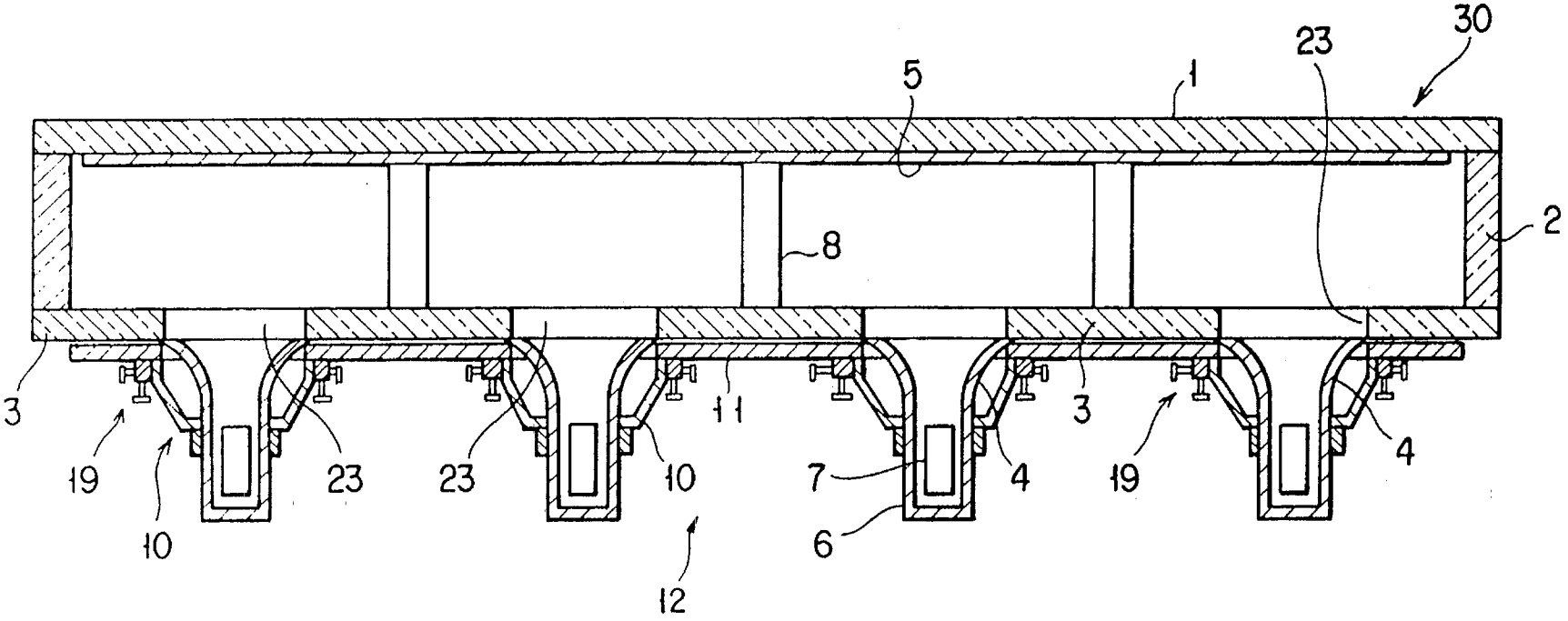

FIGS. 1 and 2 show a cathode ray tube apparatus according to an embodiment of the invention. As is shown in the figures, the cathode ray tube apparatus has a vacuum envelope 30, which comprises a face plate (first plate) 1 formed by a substantially-rectangular flat glass, side walls 2 fixed to the peripheral portion of the face plate 1 and extending substantially perpendicular to the face plate 1, a rear plate (second plate) 3 formed by a substantially-rectangular flat glass and coupled to the face plate 1 through the side walls 2 in parallel to the face plate, and a plurality (e.g. 5 rows×4 columns=20) of funnels 4 fixed to the rear plate 3. The rear plate 3 has 20 (=5 rows×4 columns) openings 23 formed therein at predetermined intervals, and the funnels 4 are secured to the plate 3 to cover the openings 23, respectively.

A phosphor screen 5 is continuously formed on substantially the overall inner surface of the face plate 1. An electron gun assembly 7 is located in the neck 6 of each funnel 4 for emitting three electron beams to the screen 5. A plurality of support rods 8 serving as support means are provided between the face plate 1 and the rear plate 3. The support rods 8 are provided for supporting the face plate 1 of the vacuum envelope 30 against the atmospheric pressure applied thereto, and each has a wedge-shaped end close to the phosphor screen 5. An elemental deflection unit 10 is provided around each funnel 4 for deflecting the electron beams emitted from a corresponding electron gun assembly 7 located in the corresponding neck 6. Further, the cathode ray tube apparatus includes a shadow mask (not shown) arranged in the vacuum envelope 30 to face the phosphor screen 5.

Figure 3:
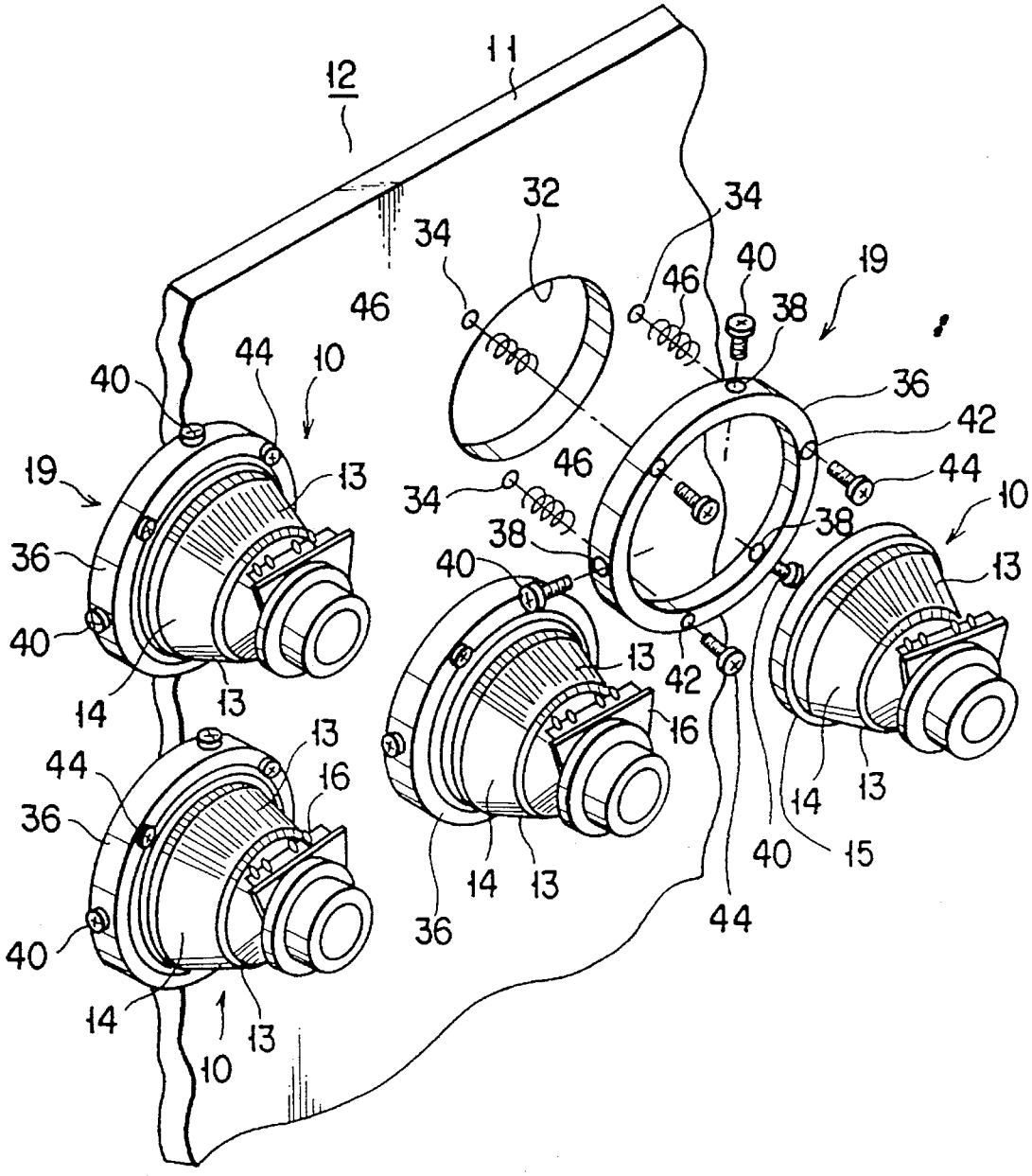

As is shown in FIGS. 2 and 3, the elemental deflection units 10 are secured to a single plate-like coupling member 11 by means of adjusting mechanisms 19 as individual adjusting means. The coupling member 11 and the elemental deflection units 10, which correspond to the individual electron gun assemblies 7 located in the necks 6 of the funnels 4, constitute in combination a deflection device 12 serving as deflection means.

Each deflection unit 10 has two pairs of deflection coils 13 for deflecting the electron beams, emitted from the corresponding electron gun assembly 7, in the vertical and horizontal directions, a core 14 formed of a magnetic material, and a mold 15 holding the deflection coils 13 and core 14 in predetermined positions, respectively. The mold 15 is of a truncated cone shape, and has a terminal table 16 provided on an outside portion for supplying deflection current to the deflection coils 13.

The coupling member 11 is rectangular and has substantially the same size as the rear plate 3 of the vacuum envelope 30, and has 20 (=5 rows×4 columns) circular openings 32 formed therein and accurately aligned with the funnels 4. Three threaded holes 34 are formed in the coupling member 11 around each opening 32. The coupling member 11 is formed of an electrically insulating material so as to restrain interference in magnetic field between adjacent deflection units 10 or loss due to eddy current.

Each adjusting mechanism 19 has an annular holding member 36, in which a large-diameter end of the mold 15 of a corresponding deflection unit 10 is inserted. The holding member 36 has a plurality (e.g. 3) of threaded holes 38 formed therein with regular intervals in the circumferential direction of the holding member and extending radially. First adjusting screws 40 are screwed in the threaded holes 38, thereby securing the deflection units 10 to the holding member 36.

The holding member 36 further has a plurality (e.g. 3) of through holes 42 formed at regular intervals in the circumferential direction and extending in the axial direction of the holding member. Second adjusting screws 44 are passed through the through holes 42 and screwed in the threaded holes 34 of the coupling member 11 through coil springs 46, respectively. Thus, each elemental deflection unit 10 is secured to the coupling member 11 by means of the corresponding holding member 36, opposed to the corresponding opening 32. The holding members 36, first and second adjusting screws 40 and 44 are formed of an electrically insulating material so as not to affect the operation of the elemental deflection units 10.

The deflection device 12 having the coupling member 11 and the elemental deflection units 10 attached thereto is secured to the rear plate 3 of the vacuum envelope 30, and the neck 6 of each funnel 4 is inserted in the corresponding elemental deflection unit 10 through the corresponding opening 32 of the coupling member 11. The mold 15 of each elemental deflection unit 10 has a small-diameter end portion mounted on the outer periphery of the inserted neck 6.

The end portion has an inner diameter slightly larger than an outer diameter of the neck 6 so that the deflection unit 10 can be adjusted in position relative to the neck 6 as described later.

In the cathode ray tube apparatus constructed as mentioned above, electron beams emitted from the individual electron gun assemblies 7 are deflected in the horizontal and vertical directions by magnetic fields generated by two pairs of deflection coils 13 located outside the funnels 4, thereby scanning corresponding regions of the phosphor screen 5, respectively. Thus, the continuous phosphor screen 5 is dividedly scanned in a plurality of regions R1, R2, . . . , R20 by the electron beams. Screen images obtained by respective scanning of the electron beams are coupled with one another by means of signals supplied to the electron gun assemblies 7 and deflection units 10, thus forming a single large reproduced image R, without discontinuity, on the phosphor screen 5.

In a cathode ray tube apparatus capable of displaying a single large screen image without discontinuity obtained by deflecting electron beams, emitted from the individual electron gun assemblies 7, by means of magnetic fields generated from the elemental deflection units 10 corresponding to the gun assemblies 7 so that the electron beams from each gun assembly can scan a corresponding region of the phosphor screen 5, the degree of pincushion-shaped deflecting distortion of the image in each region which may occur at the time of deflecting electron beams must be made equal to that of deflecting distortion of the image in the adjacent region, and further must be minimized. Therefore, the deflection magnetic field of each elemental deflection unit 10 must be accurately adjusted.

As in the conventional cathode ray tube apparatus, an ununiform magnetic distribution is necessary in order to eliminate the pincushion-shaped deflecting distortion. An ununiform magnetic field component is necessary in the case where correction (i.e., elimination of deflecting distortion) is performed by use of a deflecting current with a correction component, or by additionally using the correction component.

Moreover, in the case where predetermined deflection without deflecting distortion is performed by a deflection device for generating a deflection magnetic field with an ununiform distribution, each electron beam must be passed through the symmetry axis (center) of a corresponding deflection magnetic field, and through the center of a corresponding divisional screen region. In other words, in order to display a screen image without deflecting distortion, the axis of the electron beam, the center of the deflection magnetic field, and the center of the corresponding screen region must completely be aligned with one another, and the center axis of the electron beam be perpendicular to the phosphor screen.

In addition, in order to display a screen image without discontinuity, it is necessary to adjust the deflection device such that the rotational positions of the deflection magnetic fields of adjacent elemental deflection units 10 are identical to each other, and that the horizontal and vertical components of the deflection magnetic fields are aligned in rows and columns, respectively.

In the above embodiment, when it is necessary to adjust the positions of the elemental deflection units 10 in relation to the electron gun assemblies 7, the units 10 can be adjusted individually by the respective adjusting mechanisms 19. In the specification, the adjusting the elemental deflection units "in relation to the electron gun assembly" means adjusting the elemental deflection units in relation to the electron beams emitted from the electron gun assemblies, more concretely to the electron beams which pass the center of the corresponding screen region. Specifically, adjusting the first adjusting screws 40 can displace the elemental deflection unit 10 relative to the electron gun assembly 7 in the horizontal direction, i.e., in a direction parallel with the surface of the coupling member 11. Further, simultaneously rotating the three second adjusting screws 44 can displace the elemental deflection unit 10 in a direction perpendicular to the surface of the coupling member 11, i.e., in a direction of the beam axis, together with the holding member 36. By selectively rotating the adjusting screws 44, the angle between the center axis of the elemental deflection unit 10 and that of the electron gun assembly 7 can be changed.

According to the cathode ray tube apparatus constructed as described above, the elemental deflection units 10 are coupled to one another by the coupling member 11, and thus constitute the deflection device 12, so that all elemental deflection units 10 can be fitted to the respective funnels 4 only by attaching the coupling member 11 to the vacuum envelope 30., Moreover, since the elemental deflection units 10 are secured to predetermined portions of the coupling member 11, they can be arranged in predetermined positions with respect to the respective electron gun assemblies 7 only by attaching the deflection device 12 to the vacuum envelope 30. This makes the attaching/adjusting work easier than in the case of individually attaching the elemental deflection units 10 to the respective funnels of the cathode ray tube. If necessary, the adjusting mechanism 19 is used to adjust with ease the position of the elemental deflection unit 10 in relation to the electron gun assembly 7. Thus, it is possible to provide a cathode ray tube apparatus which can be manufactured in a simple manner and has a deflection device 12 whose position can be easily adjusted.

Then, a second embodiment according to the invention will be explained. In this embodiment, the same elements as those in the first embodiment are denoted by corresponding reference numerals, and their detailed explanation will be omitted.

Figure 4:
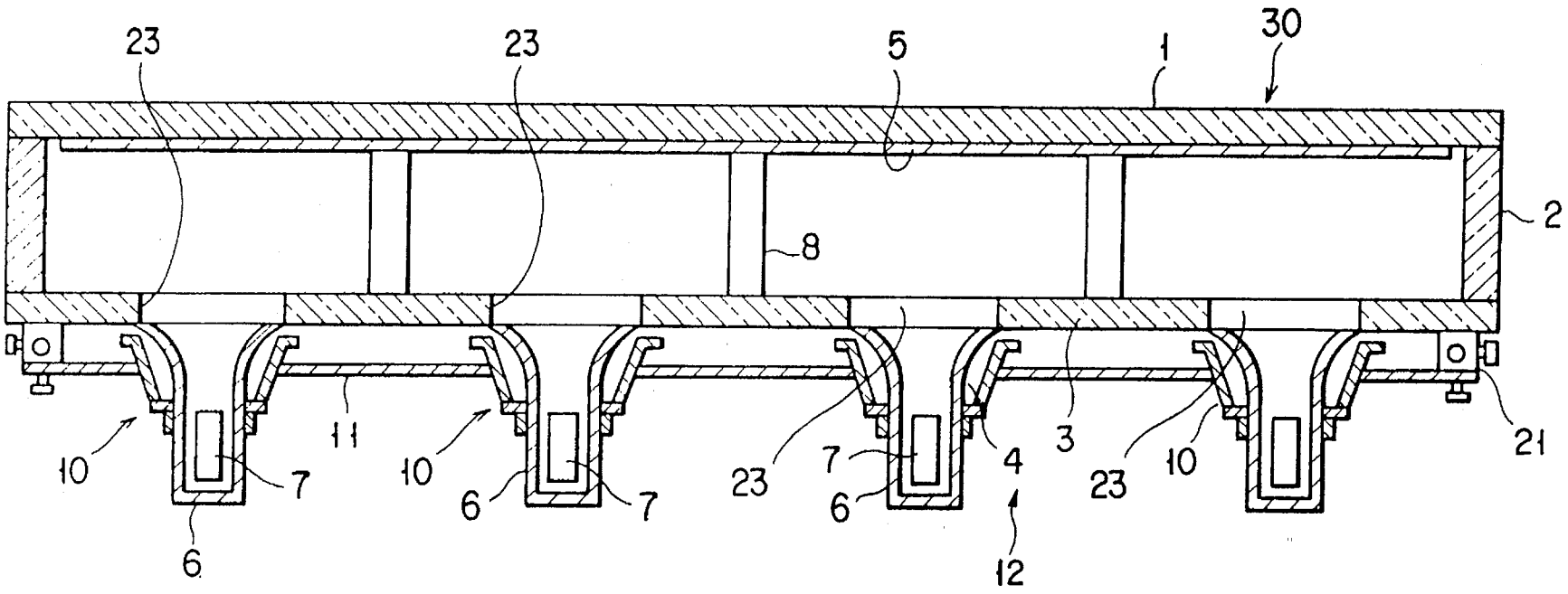
Figure 5:
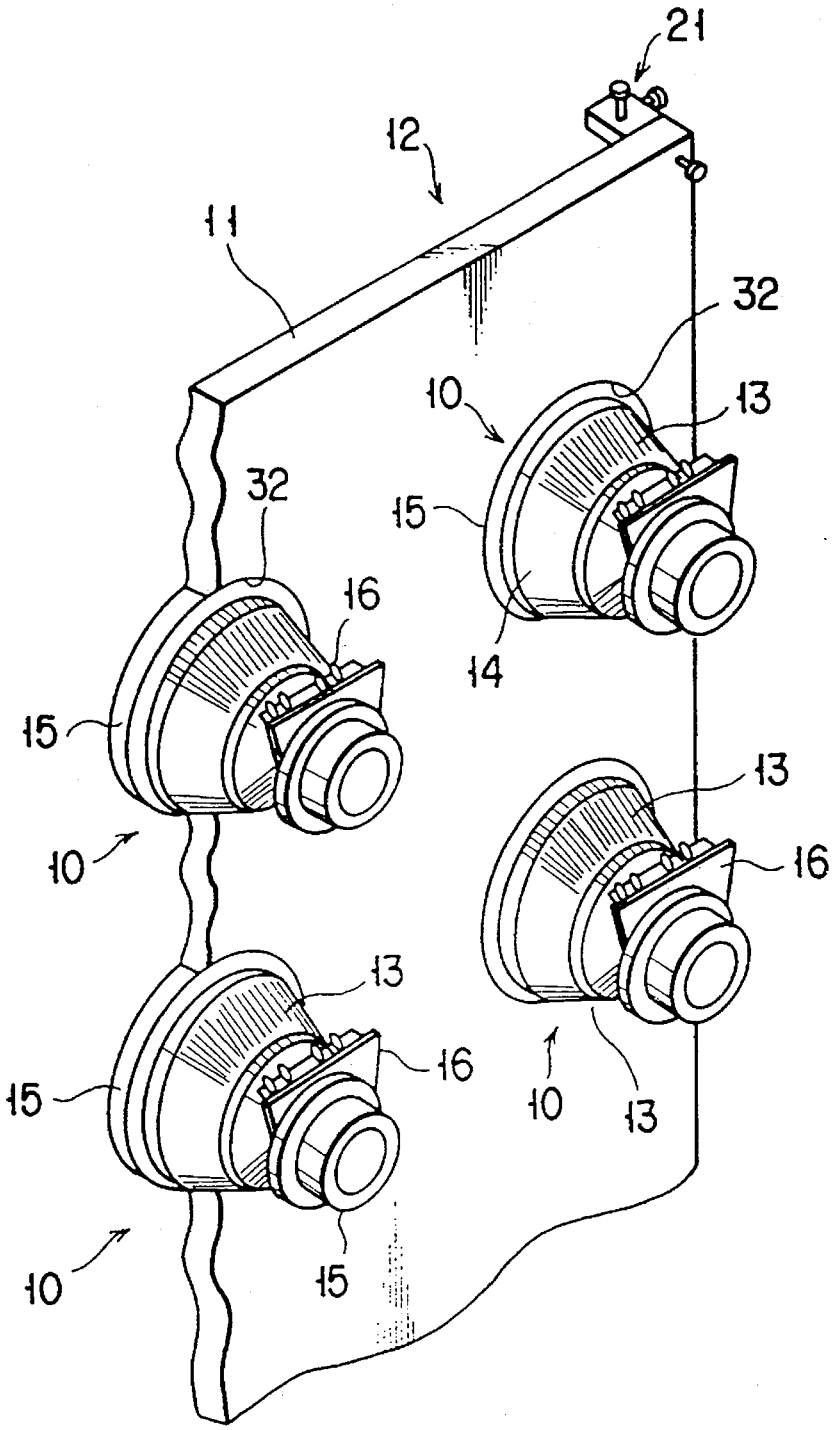

As is shown in FIGS. 4 and 5, elemental deflection units 10 are attached directly to a rectangular plate-like coupling member 11 with no adjusting mechanisms interposed therebetween, thus constituting a single deflection device 12. Specifically, each elemental deflection unit 10 has two pair of deflection coils 13 for deflecting electron beams, emitted from a corresponding electron gun assembly 7, in the vertical and horizontal directions, a core 14 formed of a magnetic material, and a mold 15 holding the deflection coils 13 and core 14 in predetermined positions, respectively. The mold 15 is of a truncated cone shape, and has a terminal table 16 provided on an outside portion thereof for supplying deflection current to the deflection coils 13. Each elemental deflection unit 10 is attached to the coupling member 11 with the large-diameter end of the mold 15 fitted in a corresponding circular opening 32 of the coupling member 11.

In the second embodiment, the deflection device 12 is secured to a rear plate 3 of a vacuum envelope 30 by means of a plurality of adjusting/fixing mechanisms 21. The mechanisms 21 are provided at the four corners of the coupling member 11, thereby adjusting the relative position between the coupling member 11 and the vacuum envelope 30 and fixings the deflection device 12 to the vacuum envelope 30.

Figure 6:
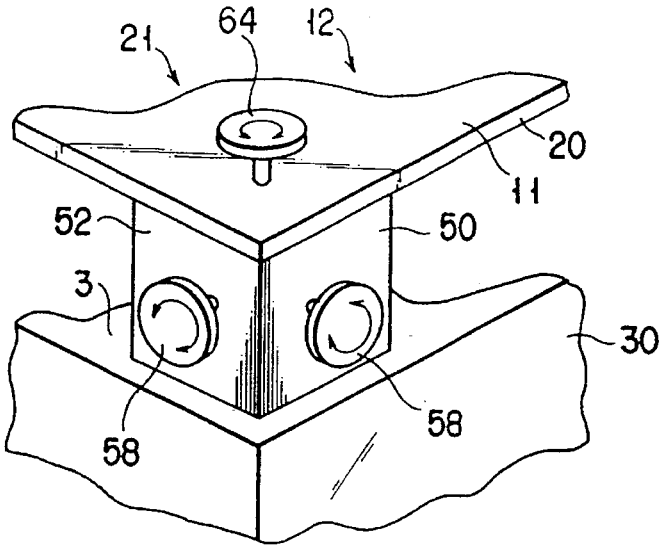
Figure 7:
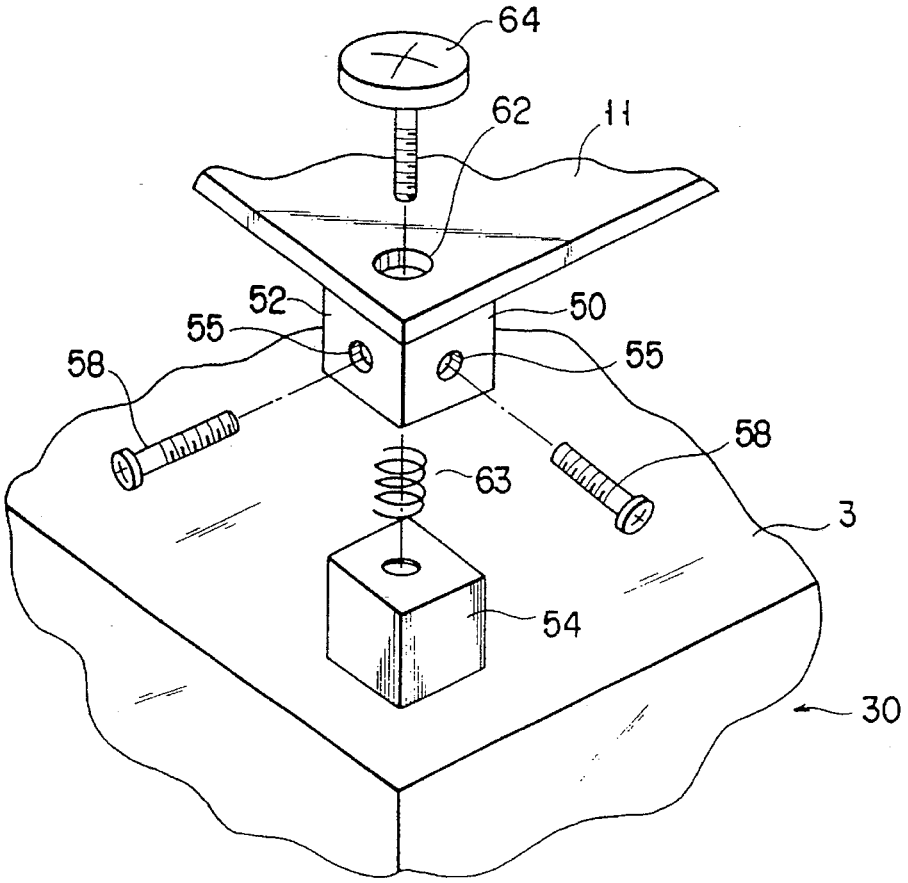

As is shown in FIGS. 6 and 7, each adjusting/fixing mechanism 21 has vertical walls 50 and 52 extending perpendicular to each other and projecting from each corner of the coupling member 11, and a prismatic fixing portion 54 projecting from a corresponding corner of the rear plate 3. The vertical walls 50 and 52 are engaged with the fixing portion 54, serving as an engaging portion in the invention. In a state where the deflection device 12 is fitted to the rear plate 3, the vertical walls 50 and 52 oppose side surfaces of the fixing portion 54, and the upper surface of the fixing portion 54 faces the lower surface of the coupling member 11.

Each of the vertical walls 50 and 52 has a threaded hole 55, into which a first adjusting screw 58 is screwed. The tip of the screw 58 abuts against the side surface of the fixing portion 54. Thus, by rotating the first adjusting screws 58, the deflection device 12 can be displaced in the horizontal direction, i.e., in a direction parallel with the surface of the rear plate 3. A threaded hole 60 is formed in the upper surface of the fixing portion 54 such that it extends perpendicular to the surface of the rear plate 3. A second adjusting screw 64 is screwed in the threaded hole 60 through a through hole 62, formed in the coupling member 11, and a coil spring 63. Rotating the second adjusting screws 64 by the same tunes or selectively rotating the screws 64 can adjust the distance between the rear plate 3 and the coupling member 11, or the angle therebetween. The diameters of the through hole 62 and the coil spring 63 are set larger than that of the shaft of the second adjusting screw 64 so as to allow the coupling member 11 to move in the horizontal direction.

The components of the adjusting/fixing mechanism 21 such as the vertical walls 50 and 52, screws 58 and 64, etc. are formed of an electrically insulating material. A desired number of adjusting/fixing mechanisms can be provided at desired locations, if they are arranged between the coupling member 11 and the rear plate 3 at locations where they do not interfere with other components.

Figure 8:
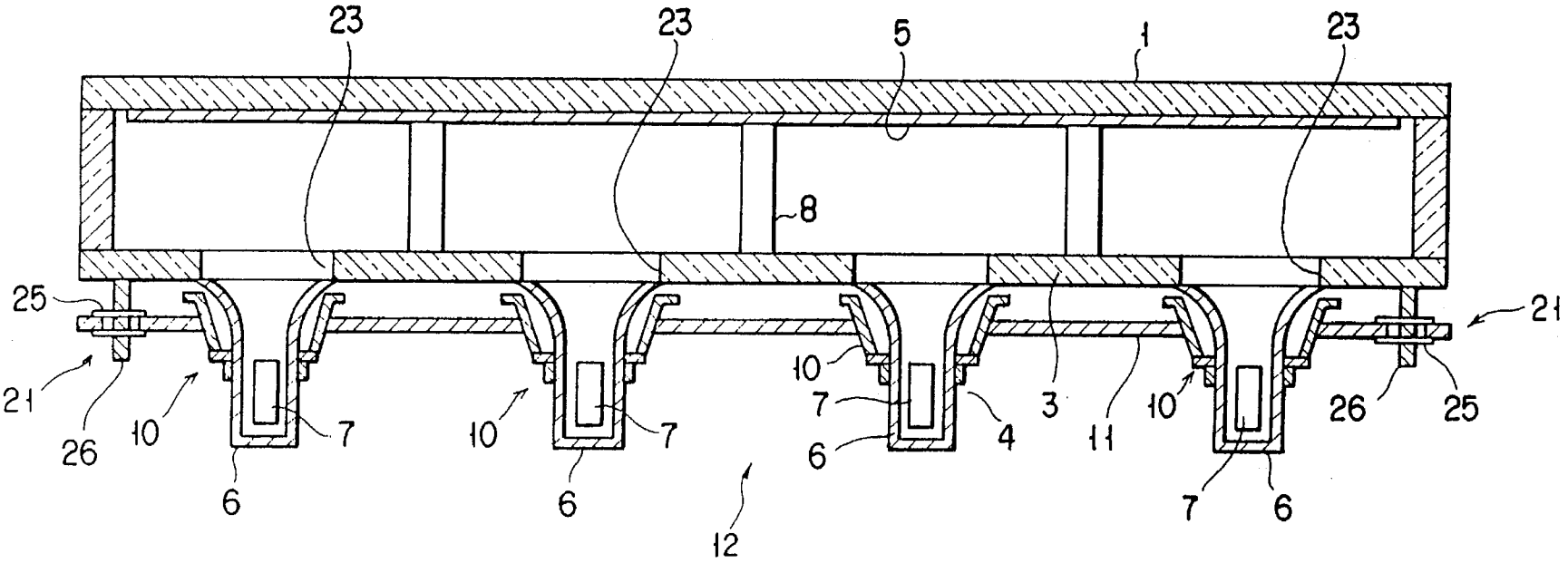
Figure 9:
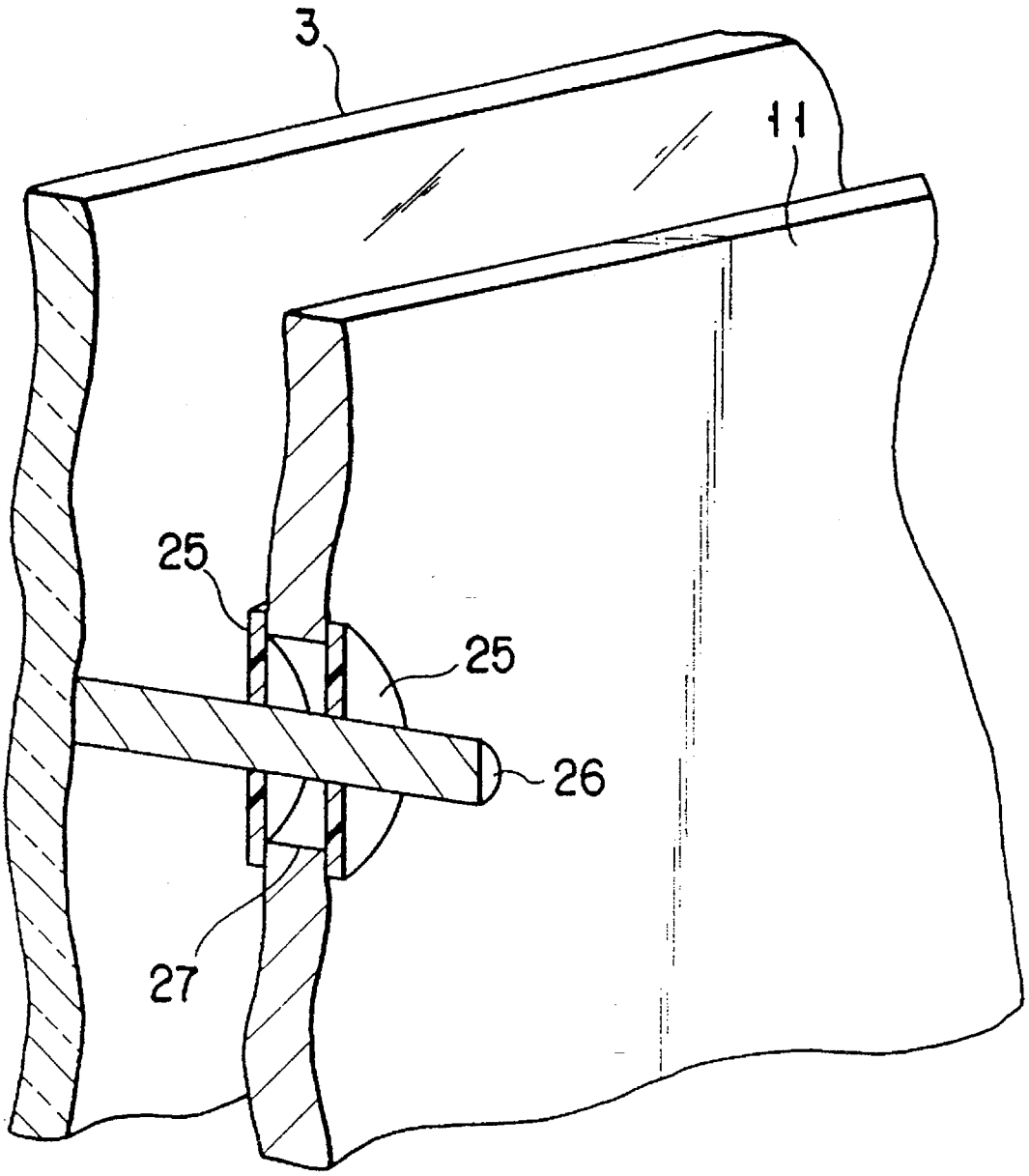

FIGS. 8 and 9 show a simplified structure of the adjusting/fixing mechanism 21. This mechanism 21 has a support bar 26 perpendicularly extending from the rear plate 3 to the coupling member 11. The coupling member 11 has a through hole 27 larger than the diameter of the bar 26, through which the bar 26 extends. Circular plates 25 made of an elastic resin are secured to the upper and lower surfaces of the coupling member 11 and close the upper and lower openings of the through hole 27. The support bar 26 extends through the plates 25. Thus, the deflection device 12 is secured to a predetermined portion of the vacuum envelope 30 by means of frictional contact between the support bars 26 and the plates 25.

With the adjusting/fixing mechanism 21 constructed as described above, horizontal adjustment of the deflection device 12 is performed by moving the coupling member 11 within a range in which the support bars 26 are held by the plates 25. Further, vertical adjustment of the deflection device 12 is performed by vertically moving the coupling member 11 along the support bars 26. Adjusting some of the adjusting/fixing mechanisms 21 in combination can adjust the inclination of the deflection device 12 in relation to the vacuum envelope 30. These adjusting/fixing mechanisms 21 can be arranged as in the second embodiment, and an appropriate maximum adjustment amount can be obtained by use of a support bar 26 of a desired size and a plate 25 of a desired size.

In the case of the cathode ray tube apparatus according to the second embodiment or the apparatus having the simplified adjusting/fixing mechanisms according to the above modification, the elemental deflection units 10 can be accurately and simply arranged in respective predetermined positions relating to the cathode ray tube. This can easily solve the aforementioned problems.

In summary, with the deflection device 12 having the above-mentioned construction, upon attaching the device 12, the elemental deflection units 10 can be secured to the coupling member 11 in respective predetermined (adjusted) position by use of a standard jig and a standard cathode ray tube, and thus constitute an integral one body (i.e., the deflection device 12). Therefore, by securing the deflection device 12 as one body to the cathode ray tube, all the elemental deflection units 10 can be arranged in the respective predetermined positions after only one adjustment. In other words, it is not necessary to adjust each of the elemental deflection units 10.

Figure 10:
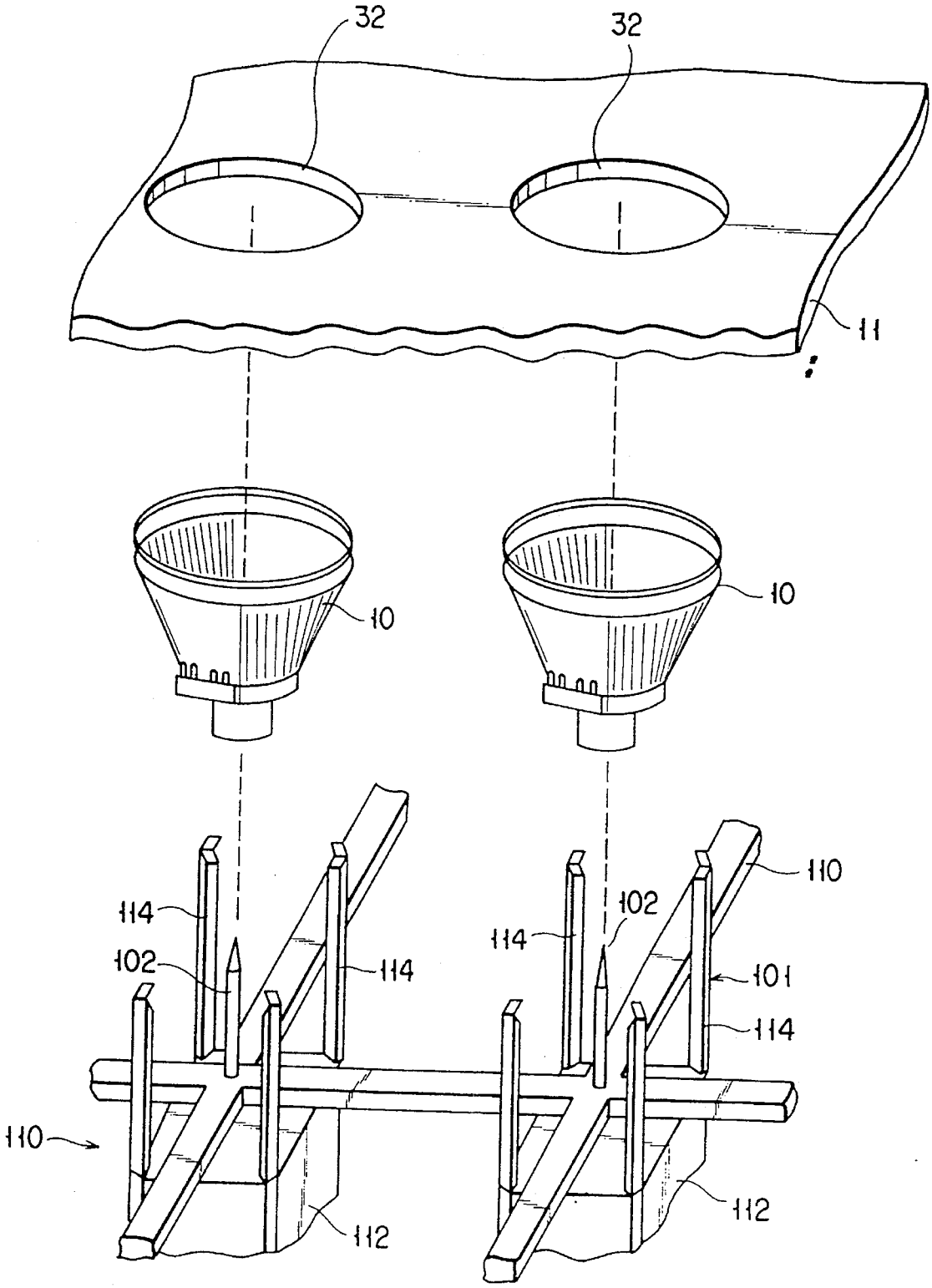
FIG. 10 is an exploded perspective view useful in explaining a method for manufacturing the cathode ray tube apparatuses according to the invention.
Figure 11:
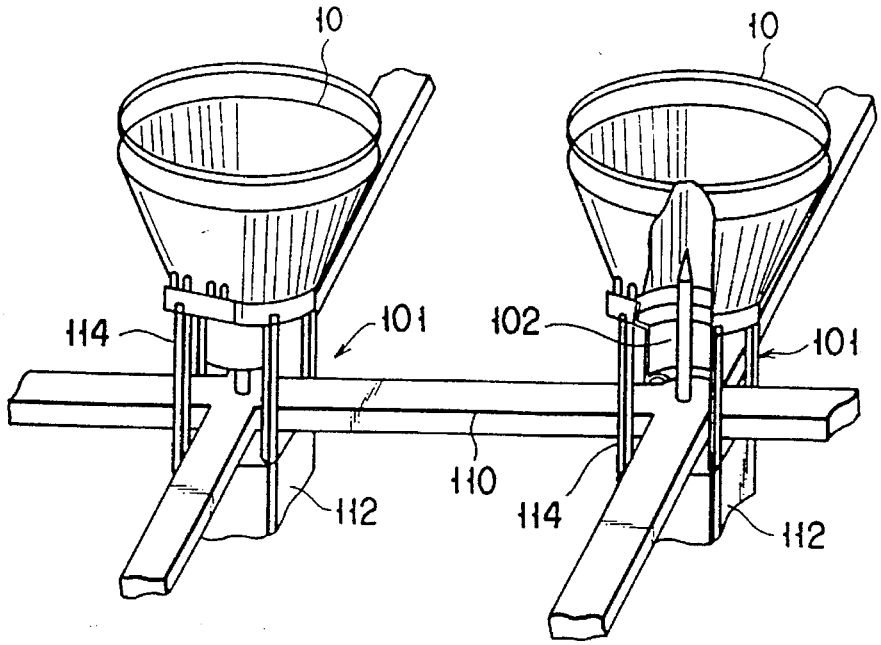
FIG. 11 is a perspective view showing a state in which two deflection units are attached to a standard jig.
Figure 12:
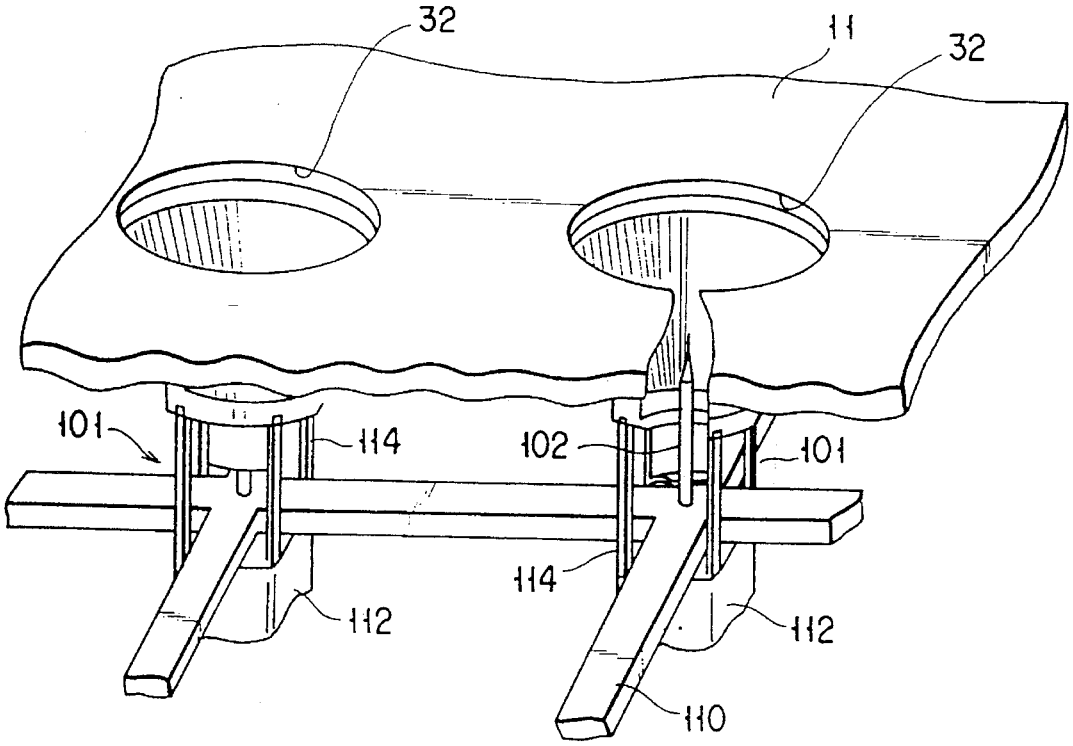
FIG. 12 is a perspective view showing a state in which two deflection units are fitted in a coupling member by use of the standard jig.

Now, a method of manufacturing the above mentioned deflection device by use of a standard jig will be explained with reference to FIGS. 10 to 12.

The standard jig for positioning the elemental deflection units 10 to the coupling member 11 has a plurality of position setting units 101, and a plurality of probes 102 for measuring a deflection magnetic field. The number of the position setting units 101 and that of the probes 102 correspond to the number of the elemental deflection units 10. Each probe 102 is fixed to a corresponding intersection of the grating of a support frame 110, and can simultaneously measure magnetic fields in directions of at least three axes. The probes 102 are provided in predetermined positions accurately corresponding to the electron beams emitted from the electron gun assemblies 7 of the cathode ray tube. Each position setting unit 101 has a base 112 and four support arms 114 projecting therefrom, and has degrees of freedom in all directions in relation to a corresponding probe 102.

To assemble the deflection device 12, first, each elemental deflection unit 10 is temporarily fixed to the support arms 114 of a corresponding position setting unit 101, and then a corresponding probe 102 for measuring a deflection magnetic field is inserted in the deflection unit 10. In this state, the deflection unit 10 is energized to generate a magnetic field, and the probe 102 measures the same. Thereafter, as is shown in FIG. 11, each deflection unit 103 is shifted to a preset reference position manually or automatically based on the measurement value obtained from the probe 102. After positioning of each deflection unit 10 is completed, the coupling member 11 is fixed to all the deflection units 10 as shown in FIG. 12, and temporal tacking is released so as to remove the position setting units 101 from the deflection units 10, thus providing the deflection device 12 as one body with the deflection device 12 assembled as described above, the elemental deflection units 10 are accurately aligned with the electron gun assemblies 7 of the cathode ray tube. Accordingly, attaching the deflection device 12 to the cathode ray tube can omit adjustment of the positions of the deflection units 10 relative to the cathode ray tube.

However, when the deflection device 12 is attached to the cathode ray tube, there remains possibility that the center axis of the electron beams emitted from each electron gun assembly 7 does not completely aligned with the center of a corresponding region of the phosphor screen 5. Therefore, as in the conventional cathode ray tube apparatus, fine adjustment of positional relationship among the center axis of the electron beams, the center axis of the deflection magnetic field of the elemental deflection unit 103, and the center of the corresponding region of the screen is performed by use of a centering magnet (not shown) provided on the deflection unit, for generating magnetic field with multi polarities.

Further, as regards rotation in the vertical direction, there remains possibility that the regions of the phosphor screen 5 do not completely aligned with the elemental deflection units 10, respectively. To overcome these, the vertical and horizontal positions and inclination of the overall deflection device 12 can be adjusted by the adjusting/ fixing mechanisms 21.

with the second embodiment having the above-described structure, a plurality of elemental deflection units 10 are secured to the single coupling member 11 to form the deflection device 12 as one body, so that they can be mounted in predetermined positions corresponding to the electron gun assemblies, respectively, only by attaching the deflection device 12 to the cathode ray tube. Moreover, since plural elemental deflection units are accurately secured in predetermined positions by the above-described manufacturing method, it is not necessary to individually adjust the position of the elemental deflection units at the time of mounting the deflection device onto the cathode ray tube, much facilitating the assembling work. Adjusting the adjusting/fixing mechanisms 21 enables the positions of the plural deflection units 10 to simultaneously be adjusted, facilitating the position adjustment. It is also available to provide a reference position at each of the cathode ray tube, coupling member, and elemental deflection unit, during the design of the apparatus. In this case, if manufacturing accuracy of parts and assembling accuracy of the apparatus is high, the deflection device can be accurately positioned to the cathode ray tube by assembling the components with reference to the reference positions, thereby more facilitating the position adjustment. Further, in the embodiment, the center axis of the electron beams can accurately be aligned with the center of the corresponding screen region, and deformed portions occurring in screen regions due to deflecting distortion can have symmetrical shapes in adjacent screen regions. This facilitates correction of the deflecting distortion, with the result that a screen image without discontinuity between adjacent screen regions can be displayed, providing a high quality cathode ray tube apparatus.

In the first and second embodiment, adjustment of the adjusting mechanisms for the elemental deflection units and adjusting of the positioning/fixing mechanisms can be performed automatically in accordance with image data displayed on the screen of the cathode ray tube or predetermined data. Specifically, by using an automatic control device, the amount of adjustment of the adjusting means, such as amount of rotation of the adjusting screw is controlled based on the data. Upon manufacturing the apparatus the deflection device can be moved to a desired position by input movement data, and the adjustment operation can be performed manually.

The present invention is not limited to the above-described embodiments, but can be modified without departing from the scope thereof.

Although in the embodiments, elemental deflection units and a coupling member separating therefrom are prepared, and then the units are secured to the coupling member to form a deflection device as one body, a single body having a portion corresponding to the elemental deflection units and a portion corresponding to the coupling member can be prepared in place of separate members to be assembled later. Further, the coupling member may have a multi-layered structure instead of the above-mentioned single-layer structure.

Moreover, in the second embodiment, the deflection device 12 may have adjusting mechanisms 19 for adjusting the elemental deflection units 10 in relation to the coupling member 11 as in the first embodiment.

In the embodiments described above, all elemental deflection units are secured to a single coupling member. Nonetheless, in the invention, the deflecting units of each row or each column may be secured to one coupling member. Also in this case, the plurality of elemental deflection units can simultaneously be attached to the cathode ray tube, facilitating the manufacture of the apparatus or the position adjustment than in the case where the elemental deflection units are attached to the cathode ray tube one by one. It is a matter of course to provide another parts on the coupling member. Although each of the elemental deflection units has the mold, each of the elemental deflection units is only required to include deflection coils and the mold may be omitted.

In addition, although in the embodiments, the adjusting mechanism and the centering magnet are used to align the center axis of the electron beams with the center of the deflection magnetic field, electrical correcting means may be used in place of them. In the case where each electron gun assembly is arranged with extreme accuracy relative to the phosphor screen, the above correction means can be omitted.

Yet further, although in the embodiments, explanation is given of a color cathode ray tube wherein the individual electron gun assembly emits three electron beams, the invention is not limited to this, but applicable also to a monochrome cathode ray tube in which an individual electron gun assembly for emitting a single electron beam is provided in a neck, a beam index type cathode ray tube, or to a color cathode ray tube in which equivalent three electron beams are obtained from a single electron beam, emitted from each electron gun assembly, by use of electromagnetic deflection or electrostatic deflection.

Additional advantages and modifications will readily occur to those skilled in the art. Therefore, the invention in its broader aspects is not limited to the specific details, representative devices, and illustrated examples shown and described herein. Accordingly, various modifications may be made without departing from the spirit or scope of the general inventive concept as defined by the appended claims and their equivalents.

What is claimed is:

1. A method of manufacturing a cathode ray tube apparatus, said method comprising the steps of:

preparing a vacuum envelope including a first plate, a second plate opposing said first plate, a phosphor screen formed on an inner surface of said first plate and a plurality of electron gun assemblies each for emitting at least one electron beam to said phosphor screen;

preparing a plurality of elemental deflection units, each elemental deflection unit in said plurality of elemental deflection units being associated with one electron gun assembly in said plurality of electron gun assemblies for deflecting said electron beams emitted from said electron gun assemblies to scan said phosphor screen dividedly;

fixing at least two of said elemental deflection units in said plurality of elemental deflection units associated with separate electron gun assemblies to predetermined portions of a same coupling member; and attaching said coupling member, to which said at least two elemental deflection units are fixed, to said vacuum envelope.

2. A method according to claim 1, wherein said fixing step includes temporarily positioning said at least two elemental deflection units, generating a magnetic field from each elemental deflection unit temporarily positioned, measuring said magnetic field, adjusting said position of said at least two elemental deflection unit based on said measured value, and fixing said at least two elemental deflection units to said coupling member after adjustment.

3. A method according to claim 1, further comprising a step of adjusting positions of said at least two elemental deflection units after said coupling member is attached to said envelope.

4. A method according to claim 3, wherein said adjusting step includes adjusting said position of each of said at least two elemental deflection units in relation to said coupling member.

5. A method according to claim 3, wherein said adjusting step includes adjusting said position of said coupling member in relation to said vacuum envelope.

* * * * *